US010323829B1

(12) United States Patent
Zauhar et al.

(10) Patent No.: US 10,323,829 B1
(45) Date of Patent: Jun. 18, 2019

(54) MULTI-BEAM ANGLE SPOTLIGHT

(71) Applicant: Chien Luen Industries Co., Ltd., Inc., Oakland Park, FL (US)

(72) Inventors: Zachary Zauhar, Oakland Park, FL (US); Willard Passauer, III, Fort Lauderdale, FL (US); Charles Bucher, Tampa, FL (US); Tien S. Lowe, Cooper City, FL (US)

(73) Assignee: Chien Luen Industries Co., Ltd., Inc., Oakland Park, FL (US)

( * ) Notice: Subject to any disclaimer, the term of this patent is extended or adjusted under 35 U.S.C. 154(b) by 0 days.

(21) Appl. No.: 16/003,326

(22) Filed: Jun. 8, 2018

Related U.S. Application Data

(60) Provisional application No. 62/530,342, filed on Jul. 10, 2017.

(51) Int. Cl.

| | |
|---|---|
| ***F21V 14/06*** | (2006.01) |
| ***F21V 21/08*** | (2006.01) |
| ***F21V 21/30*** | (2006.01) |
| ***F21V 29/70*** | (2015.01) |
| ***F21S 8/08*** | (2006.01) |
| *F21Y 115/10* | (2016.01) |

(52) U.S. Cl.
CPC ..... *F21V 14/06* (2013.01); *F21S 8/081* (2013.01); *F21V 21/0824* (2013.01); *F21V 21/30* (2013.01); *F21V 29/70* (2015.01); *F21Y 2115/10* (2016.08)

(58) Field of Classification Search
CPC ..... F21V 14/06; F21V 21/30; F21V 21/0824; F21V 29/70; F21S 8/081
See application file for complete search history.

(56) References Cited

U.S. PATENT DOCUMENTS

| | | | |
|---|---|---|---|
| 4,232,359 | A | 11/1980 | Leon et al. |
| 6,776,508 | B2 | 8/2004 | Bucher et al. |
| 6,866,401 | B2 | 3/2005 | Sommers et al. |
| 7,192,162 | B2 | 3/2007 | Tanaka et al. |

(Continued)

FOREIGN PATENT DOCUMENTS

| | | |
|---|---|---|
| CN | 202281065 | 6/2012 |
| CN | 204116690 | 1/2015 |

(Continued)

*Primary Examiner* — Thomas M Sember
(74) *Attorney, Agent, or Firm* — Brian S. Steinberger; Law Offices of Brian S. Steinberger, P.A.

(57) ABSTRACT

Systems, devices, and methods for adjusting and focusing a beam light spread to separate beams spreads of approximately 80 degrees, approximately 60 degrees, approximately 40 degrees and approximately 20 degrees in a spotlight. The spotlight can be used in landscape and pathway spot lights. A disc with three lenses thereon can be positioned in front of an LED (light emitting diode) lights source having a primary lens in front of the light source. The primary lens can adjust the light spread to approximately 80 degrees. Each of the three lenses on the disc can adjust the light spread further to approximately 20 degrees, approximately 40 degrees, and approximately 60 degrees. The spotlight can be mounted on a ground based stake. A mechanically rotatable knob/wheel can be physically rotated by the user to mechanically adjust the single disc to the four different positions in order to change the beam angle to anyone of the four light spread angles. The light can be mounted indoors as well as outdoors.

20 Claims, 5 Drawing Sheets

(56) References Cited

U.S. PATENT DOCUMENTS

| | | | |
|---|---|---|---|
| 8,632,234 | B1 | 1/2014 | Lowe et al. |
| 9,249,953 | B2 | 2/2016 | Miskin |
| 9,310,059 | B2 | 4/2016 | Zhang |
| 9,541,263 | B2 | 1/2017 | Beausoleil |
| 2006/0104063 | A1 | 5/2006 | Dunne et al. |
| 2017/0082254 | A1 | 3/2017 | Zhang |

FOREIGN PATENT DOCUMENTS

| | | |
|---|---|---|
| CN | 205447440 | 8/2016 |
| CN | 205592905 | 9/2016 |
| DE | 102010008041 | 8/2011 |
| EP | 2503231 | 3/2012 |
| JP | 0225830 | 1/1990 |

MULTI-BEAM ANGLE SPOTLIGHT

CROSS REFERENCE TO RELATED APPLICATIONS

This application claims the benefit of priority to U.S. Provisional Application Ser. No. 62/530,342 filed Jul. 10, 2017, which is incorporated by reference in its' entirety.

FIELD OF INVENTION

This invention relates to landscape and pathway spot lights, and in particular to systems, devices, and methods for adjusting and focusing a beam light spread to separate beams spreads of approximately 80 degrees, 60 degrees, 40 degrees and 20 degrees by a rotatable disc having a plurality of lenses thereon positioned in front of a primary lens fixed in front of an LED (light emitting diode) light source in a spotlight housing mounted on a stake, with a mechanically rotatable knob/wheel for adjustably rotating the single disc to the plurality of different positions.

BACKGROUND AND PRIOR ART

Ground based landscape lighting directional fixtures having ground based spikes have typically been constructed to have a single beam angle set during the time of manufacture. This single beam angle option can limit the end user's application of the light. If a customer desires a different beam angle, their only option today would be to purchase a different fixture.

Purchasing a plurality of different fixtures can be an expensive and be time consuming and labor intensive to be installed.

Thus, the need exists for solutions to the above problems with the prior art.

SUMMARY OF THE INVENTION

A primary objective of the present invention is to provide systems, devices, and methods for adjusting and focusing a beam light spread to separate beam angle spreads by rotating a disc of lenses in front of a primary lens fixed in front of a light source.

A secondary objective of the present invention is to provide systems, devices, and methods for adjusting and focusing a beam light spread to separate beams spreads of approximately 80, 60, 40 and 20 degrees by a rotatable disc having a plurality of lenses thereon.

A third objective of the present invention is to provide systems, devices, and methods for adjusting and focusing a beam light spread to separate beam angle spreads by rotating a disc of lenses in front of a primary lens fixed in front of a light source.

A spotlight embodiment can include a single housing, a light source in the single housing for emitting a light beam with a light spread therefrom, a disc rotatably supported within the single housing in front of the light source, and a plurality of lens positioned about the disc for allowing light to pass therethrough, each of the plurality of lens for narrowing the light spread to different narrower light spread angles, the rotatable disc being controlled from outside the housing, wherein rotating the disc to each of the plurality of lenses, and narrows the light spread to each of the different narrower light spread angles.

The spotlight can further include a stake extending below the single housing for supporting the spotlight on a ground surface, and a pivot member attached between a top of the stake and a bottom of the housing for allowing the housing to pivot up and down relative to the stake.

The spotlight can further include a rotatable component for allowing the single housing to rotate in a parallel plane to the stake.

The light source can include an LED (light emitting diode).

The spotlight can further include a primary lens fixed in front of the light source for converting the light spread emission from the light source.

The plurality of lenses on the single disc can include three lenses.

The spotlight can further include a primary lens fixed in front of the light source for narrowing the light spread to approximately 80 degrees, a first lens on the rotatable disc for changing the light spread to approximately 20 degrees, a second lens on the rotatable disc for changing the light spread to approximately 40 degrees, and a third lens on the rotatable disc for changing the light spread to approximately 60 degrees.

The spotlight can further include a heat sink behind the light source.

The spotlight can further include a removable lens cap covering an open end of the housing.

The spotlight can further include a rotatable knob to rotate the disc.

The spotlight can further include a horizontal gear wheel attached to the rotatable knob, and a vertical gear wheel attached to the rotatable disc, wherein rotating the knob causes the horizontal gear wheel to rotate the vertical gear wheel which rotates the rotatable disc.

The spotlight can further include at least one rotatable lens on the rotatable disc having one or more lens for adjusting light spread.

The one or more lens can include a first lens on the single disc for changing the light spread to approximately 20 degrees, a second lens on the single disc for changing the light spread to approximately 40 degrees, a third lens on the single disc for changing the light spread to approximately 60 degrees, and a fourth lens on the single disc for changing the light spread to approximately 80 degrees.

A mountable light can include a cylindrical housing;

a light source in the cylindrical housing for emitting a light beam with a light spread therefrom, a disc rotatably supported within the cylindrical housing in front of the light source, and a plurality of lens positioned about the disc for allowing light to pass therethrough, each of the plurality of lens for narrowing the light spread to different narrower light spread angles, wherein rotating the disc to each of the plurality of lenses, and narrows the light spread to each of the different narrower light spread angles.

The mountable light can further include a primary lens fixed in front of the light source for converting the light spread emission from the light source.

The plurality of lenses on the single disc can include three lenses.

The mountable light can include a primary lens fixed in front of the light source for narrowing the light spread to approximately 80 degrees, a first lens on the rotatable disc for changing the light spread to approximately 20 degrees, a second lens on the rotatable disc for changing the light spread to approximately 40 degrees, and a third lens on the rotatable disc for changing the light spread to approximately 60 degrees.

The mountable light can include at least one rotatable lens on the rotatable disc having one or more lens for adjusting light spread.

The one or more lens can include a first lens on the single disc for changing the light spread to approximately 20 degrees, a second lens on the single disc for changing the light spread to approximately 40 degrees, a third lens on the single disc for changing the light spread to approximately 60 degrees, and a fourth lens on the single disc for changing the light spread to approximately 60 degrees.

The mountable light of can include a rotatable knob to rotate the disc, a horizontal gear wheel attached to the rotatable knob, and a vertical gear wheel attached to the rotatable disc, wherein rotating the knob causes the horizontal gear wheel to rotate the vertical gear wheel which rotates the rotatable disc.

Further objects and advantages of this invention will be apparent from the following detailed description of the presently preferred embodiments which are illustrated schematically in the accompanying drawings.

DESCRIPTION OF THE PREFERRED EMBODIMENTS

Figure 1:
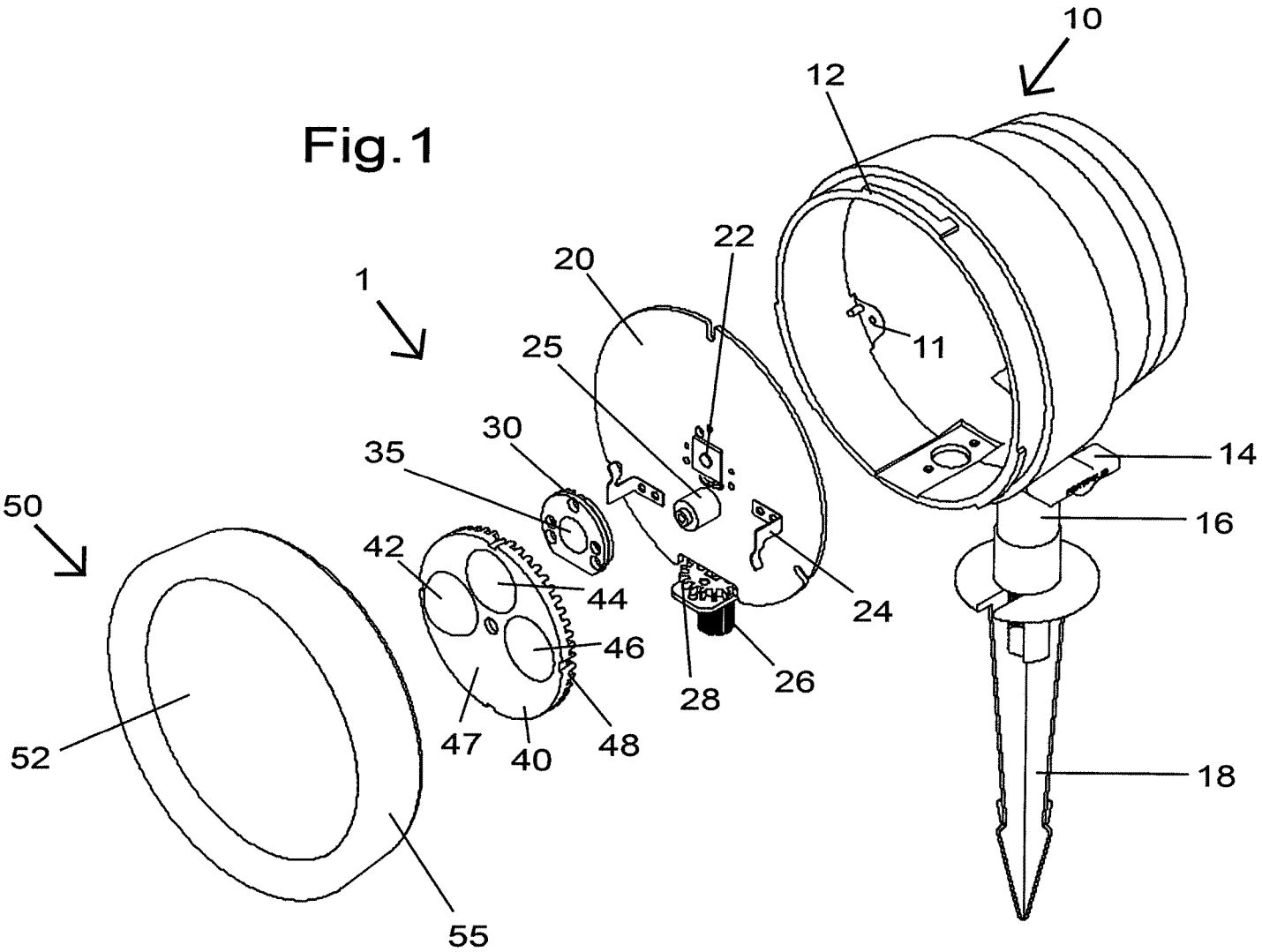
FIG. 1 is an exploded perspective view of the main components of a stake mounted spotlight.

Before explaining the disclosed embodiments of the present invention in detail it is to be understood that the invention is not limited in its applications to the details of the particular arrangements shown since the invention is capable of other embodiments. Also, the terminology used herein is for the purpose of description and not of limitation.

In the Summary above and in the Detailed Description of Preferred Embodiments and in the accompanying drawings, reference is made to particular features (including method steps) of the invention. It is to be understood that the disclosure of the invention in this specification does not include all possible combinations of such particular features. For example, where a particular feature is disclosed in the context of a particular aspect or embodiment of the invention, that feature can also be used, to the extent possible, in combination with and/or in the context of other particular aspects and embodiments of the invention, and in the invention generally.

In this section, some embodiments of the invention will be described more fully with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will convey the scope of the invention to those skilled in the art. Like numbers refer to like elements throughout, and prime notation is used to indicate similar elements in alternative embodiments.

The invention encompasses a user changeable lens assembly that gives the end user multiple, different beam angles. The directional fixture can utilize an LED as a light source which is centrally located inside the fixture. There is a disc that contains multiple lenses located in front of the LED light source. When the lens is positioned correctly in front of the light source, the angle of light is transformed. A knob on the outside of the fixture can be easily accessible by the end use. The user can turn the knob which changes the position of the disc. The disc can rotate in front of the LED light source allowing the user to change the beam angle.

A list of the main components will now be described.

1 Spot light
10 cylindrical Housing/body
11 interior tabs
12 Fastener edge
14 pivot lever control on top of stake
16 rotatable stem on stake
17 threaded fastener
18 stake
20 heat sink
21 groove edges
23 spacer shaft
22 light source (LED (light emitting diode))
24 ratchet clips
25 axle for rotatable disc/wheel 40
26 multi-select turn knob/wheel
27 horizontal gear wheel
28 horizontal gear with ratchet/sprocket edges (part of gear components between knob/wheel 26 disc/wheel 40
29 fastener
30 primary lens support
32 fasteners for support 30
35 primary lens
40 rotatable disc/wheel with secondary multi-lens
42 first lens
44 second lens
46 third lens
47 clear/transparent portion on disc/wheel 40
48 vertical gear with ratchet/sprocket edges
50 lens cap
52 main lens
54 seal rings
55 rear cap housing mount
100 second embodiment arrangement for spot light
140 rotatable disc/wheel
142 first lens
144 second lens
146 third lens

148 fourth lens

First Embodiment

Figure 2:
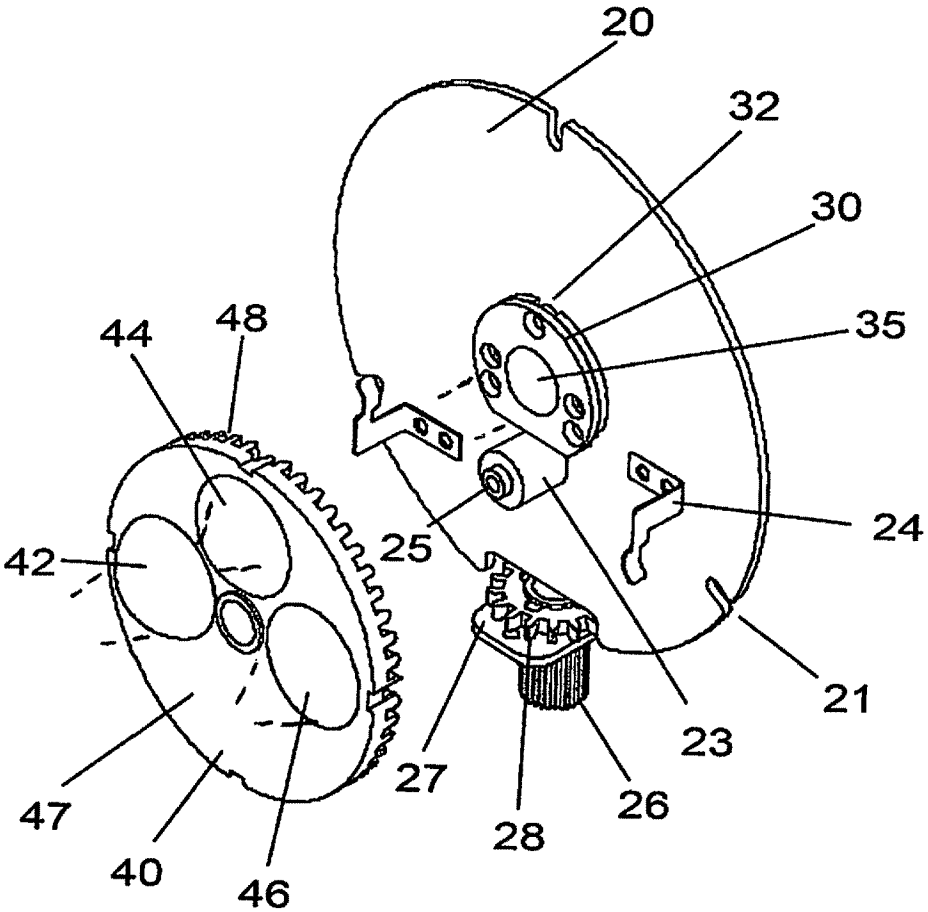
FIG. 2 is a partial exploded perspective view of the plural secondary lens on the rotatable disc spaced in front of the primary lens fixed in front of the light source that is mounted to a heat sink with rotatable knob/wheel of FIG. 1.

FIG. 1 is an exploded perspective view of the main components of a stake 18 mounted spotlight 1. FIG. 2 is a partial exploded view of the plural secondary lenses 42, 44, 46 on the rotatable disc/wheel 40 spaced in front of the primary lens support 30 with primary lens 30 fixed in front of the light source 22 that is mounted to the heat sink 20, with rotatable knob/wheel 26 of FIG. 1.

Figure 3:
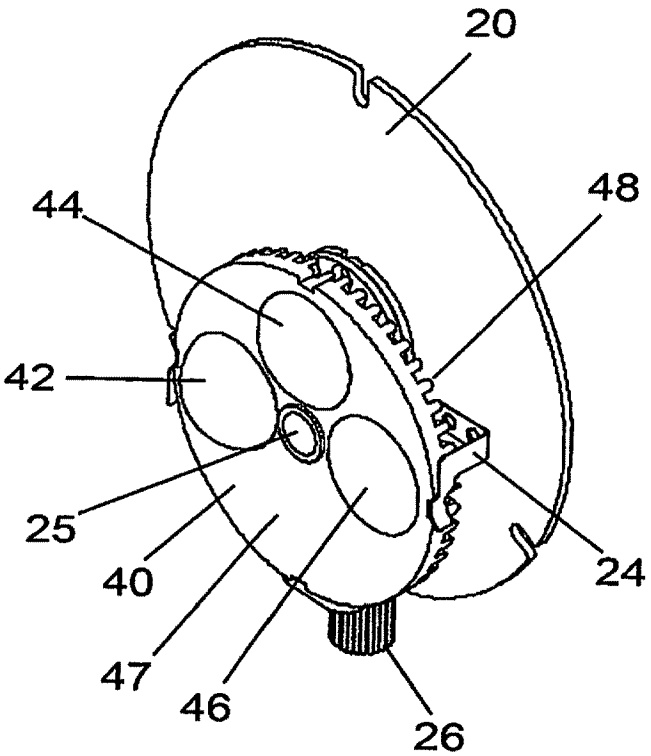
FIG. 3 is another perspective view of the secondary lens on the rotatable disc attached in front of the primary lens fixed in front of the light source that is mounted to the heat sink, with rotatable knob/wheel of FIG. 2.

FIG. 3 is another perspective view of the secondary multi-lens 42, 44, 46 on the rotatable disc/wheel 40 attached in front of the primary lens support 30 with primary lens 35 fixed in front of the light source 22 that is mounted to the heat sink 20, with rotatable knob/wheel 26 of FIG. 2.

Figure 4B:
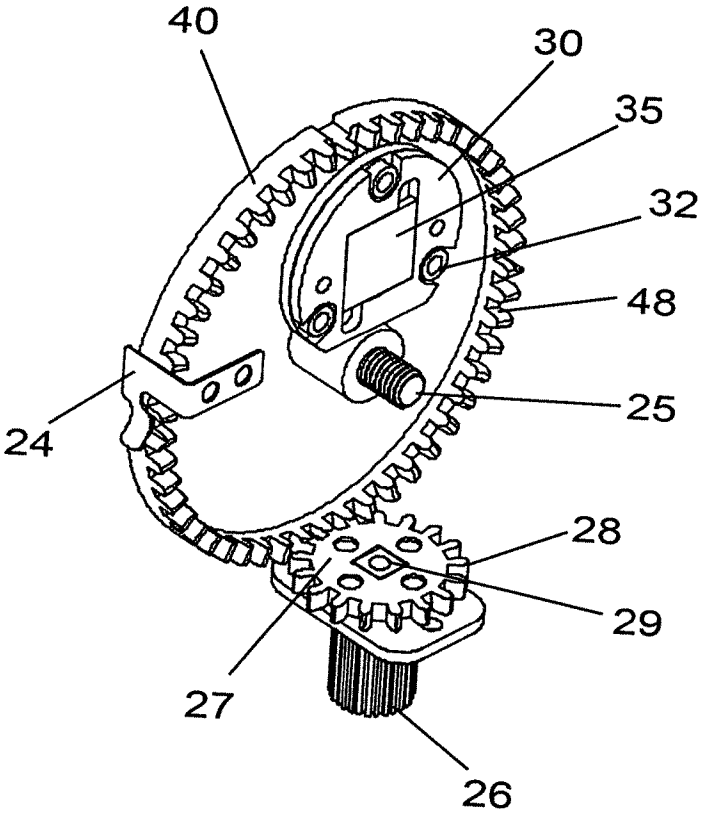
FIG. 4B is a rear perspective view of a rear side of FIG. 4A, showing gear parts between knob/wheel and the rotatable disc with the plural secondary lenses.
Figure 4A:
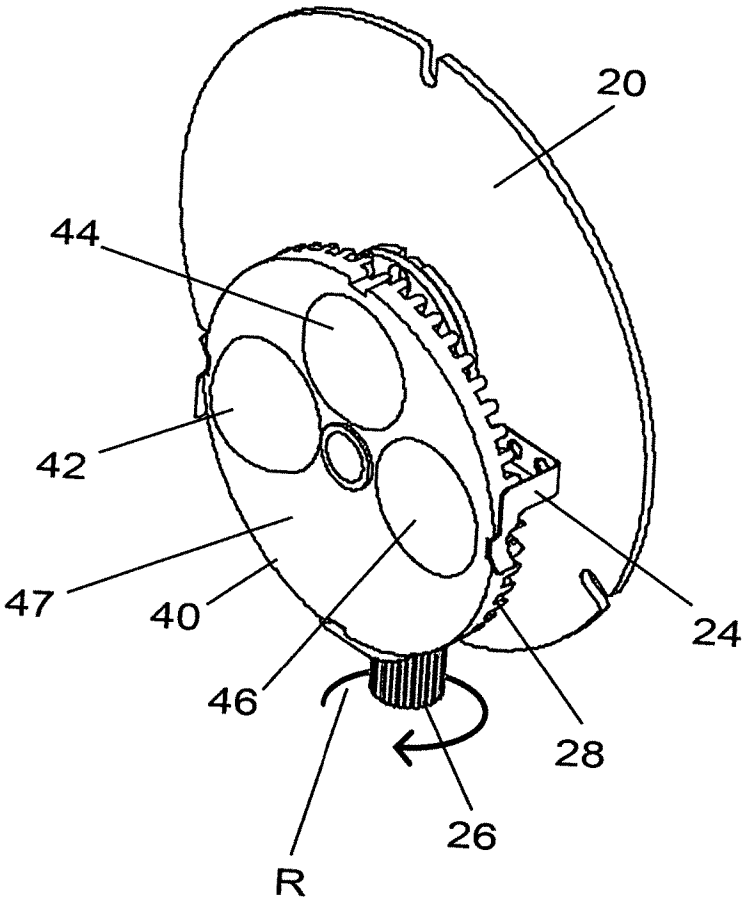
FIG. 4A is another perspective view of a front of FIG. 3 showing rotational direction of the knob/wheel.

FIG. 4A is another perspective view of the front of FIG. 3 showing rotational direction R of the knob/wheel 26. FIG. 4B is a rear perspective view of a rear side of FIG. 4A, showing gear parts 28, 48 between the knob/wheel 26 and the rotatable disc/wheel 40 with the plural secondary lenses 42, 44, 46.

Figure 5:
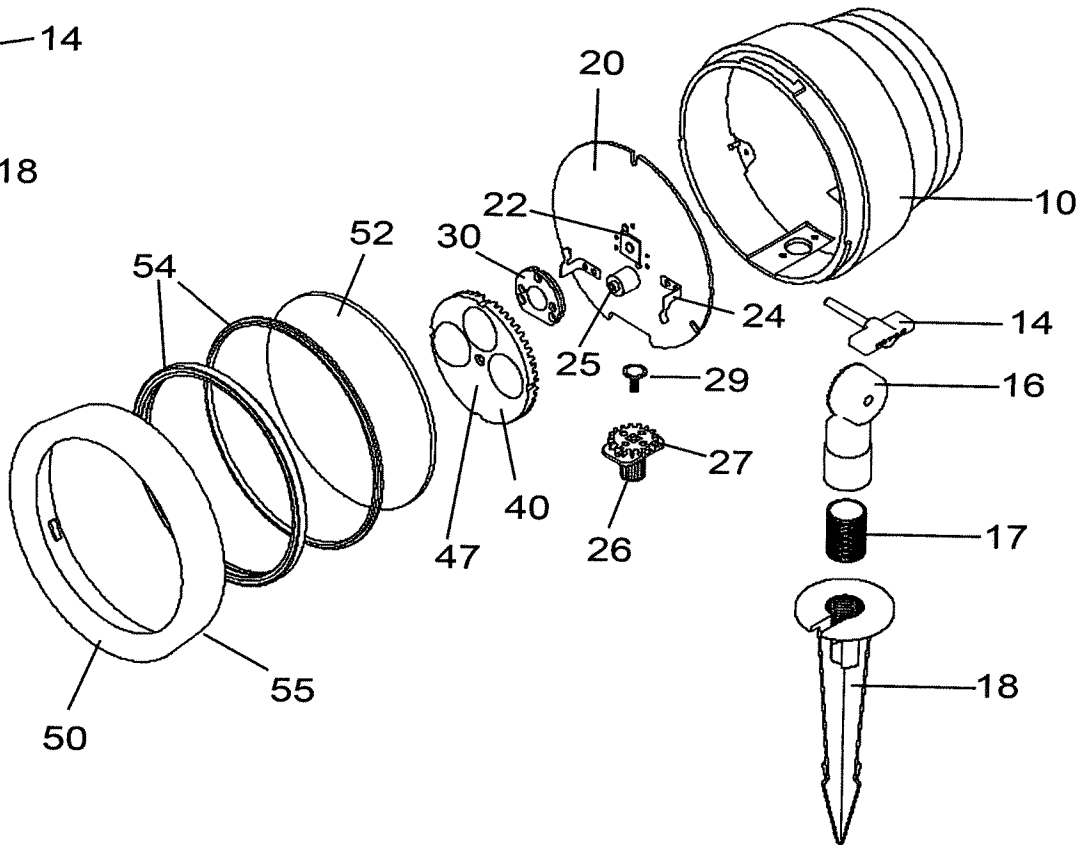
FIG. 5 is a perspective exploded view of all the main components of the spotlight of the preceding figures with the stake.

FIG. 5 is a perspective exploded view of all the main components of the spotlight 1 of the preceding figures with the stake 18.

Figure 6:
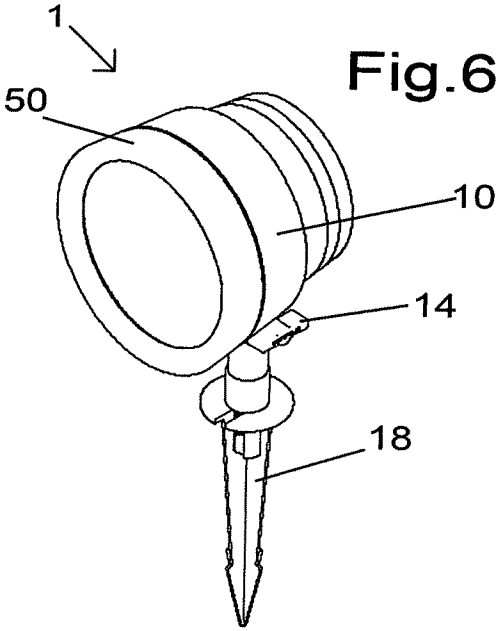
FIG. 6 is an assembled perspective view of the ground based spot light of the preceding figures.

FIG. 6 is an assembled view of the ground based spot light 1 of the preceding figures.

Referring to FIGS. 1-6, the novel spot light 1 can include a generally cylindrical housing/body 10 having a closed rear face and an opposite open end with a fastener edge 12. Underneath the housing/body 10 can be a rotatable stem 16 that can be rotatably attached to the top of a downwardly protruding stake 18 by a rotatable fastener 17. A turn knob 14 allows for the housing/body 10 to pivot up and down relative to stem 16 and ground engageable stake 18. Additionally, the fastener 17 allows for the housing/body 10 to rotate in a horizontal plane relative to the stake 18. The housing/body 10 and stake 18 can be made from molded plastic, and the like, and can include UV (ultra violet) resistant materials.

A disc shaped heat sink 20 can be mounted by groove edges 21 to interior tabs 11. The heat sink 20 can be used to draw heat from the internal components inside.

Centrally mounted on the heat sink disc 10 can be a light source 22, such as but not limited to a light emitting diode (LED). The light source 22 can be a white type light, or any type of colored, light, and the like.

Extending below the heat sink disc 20 can be mounted a multi-select rotatable knob 26, attached to a gear wheel 27 by a fastener 29. Rotating knob 26 will rotate a horizontal gear wheel 27 with gear sprocket edges 28, the functionality of which will be described later.

Extending outward from the heat sink disc 20 can be spacer shaft 23 with an axle 25 extending therefrom that can pass through a central opening of the rotatable disc/wheel 40. The spacer shaft 23 can position the rotatable disc/wheel 40 spaced apart from the heat sink disc 20. A pair of ratchet clips 24 having inner ends attached to the heat sink disc 20 can have outer bent ends that can lock into the vertical sprockets 48 of the rotatable disc/wheel 40, as the rotating turn knob 26 effectively rotates the rotatable disc/wheel 40 by gear components (sprockets) 28, 48).

A primary lens support 30 can be mounted over the light source 22 that is mounted to the face of the heat sink disc 20 by fasteners 32. A primary lens 35 can cover the light source 22.

Referring to FIGS. 1-6, the rotatable disc/wheel can be a disc shape and formed from a plastic (polycarbonate) materials. Each of the little circles (three are shown, but two or four or more can be used) are individual curved lenses 42, 44, 46 and a clear transparent portion 47 between lens 42 and 46.

As will be explained below, rotating the disc/wheel 40 can change the focus to approximately 20 degrees, or approximately 40 degrees or approximately 60 degrees or approximately 80 degrees.

Covering the front open end of the housing/body 10 can be a lens cap 50 having a generally cylindrical ring shaped that can attached to the fastener edge 12 of the housing/body 10 by threads, snaps, and the like. The lens cap 50 can support a main light passable lens 52 that can be supported by rings 54, such as gaskets, O-rings, and the like.

Referring to FIGS. 1-6, basically, the LED light source 22 can be first focused through the primary lens 35 and then focused through each of the secondary lenses 42, 44, 46, and clear/transparent portion 47 that are rotated in front of the LED light source 22 by the rotatable disc/wheel 40.

The LED light source 22 can emit light in a generally 120 degree light spread. The invention is able to take the generally 120 degrees light spread, and focus it down to 20 degrees, or 40 degrees or 60 degrees or 80 degrees.

The primary lens 35 can focus the approximately 120 degree light spread from the LED light source 22 down to approximately 80 degrees.

In one embodiment, positioning the clear/transparent portion 47 can allow for the approximately 80 degrees spread to be emitted from the lens cap 50. When the rotatable knob 26 is rotated clockwise, this causes the disc/wheel 40 to be rotated clockwise and the lens 46 can convert the approximately 80 degrees spread to approximately 60 degrees. Rotating the disc wheel 40 clockwise again allows for the lens 44 can then convert the light spread to approximately a 40 degree spread. Continuing to rotate the disc wheel 40 clockwise can allow for lens 42 to convert the light spread to approximately 20 degrees spread.

Although the disc wheel is described as rotating clockwise, the disc wheel 40 can also be rotated counter-clockwise by rotating the knob 26 counter-clockwise.

Although four lenses are shown and described, the invention can be used with more than four or less than four multi-lenses.

While the lenses allow for 20 degrees, 40 degrees, 60 degrees and 80 degrees, the invention can be used with approximately 20 degrees, approximately 40 degrees, approximately 60 degrees and approximately 80 degrees. Additionally, different degree angles can also be added less than approximately 20 degrees, and more than approximately 80 degrees, such as up to approximately 120 degrees, and the like, as well as different degrees between each of 20 degrees, 40 degrees, 60 degrees and 80 degrees, respectively.

Second Embodiment

Figure 7:
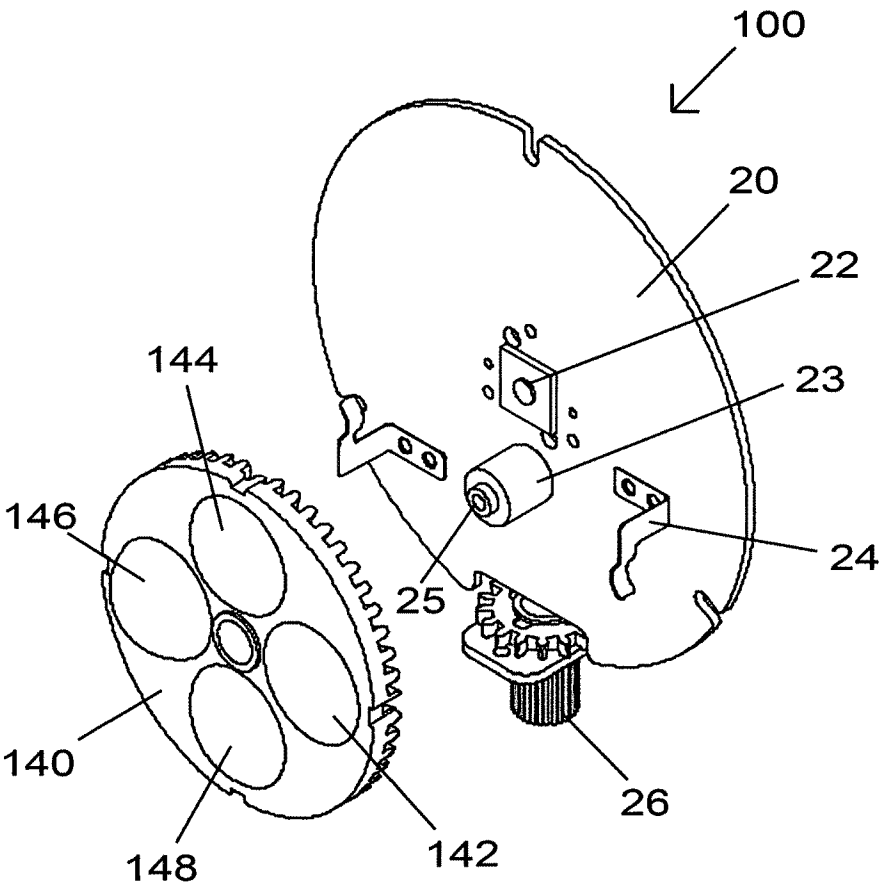
FIG. 7 shows is a partial exploded perspective view of a second embodiment arrangement of a rotatable set of lenses that does not require a fixed lens in front of the LED light source shown in FIG. 2.
Figure 8:
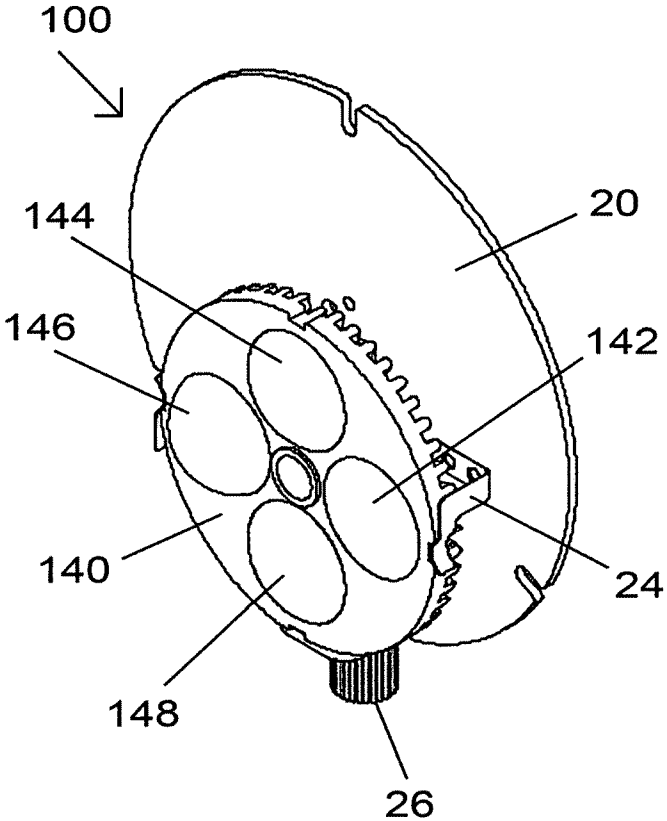
FIG. 8 shows an assembled perspective view of the components of FIG. 7.

FIG. 7 shows is a partial exploded perspective view of a second embodiment arrangement 100 of a rotatable set of lenses that does not require a fixed lens in front of the LED light source shown in FIG. 2. FIG. 8 shows an assembled perspective view of the components 100 of FIG. 7.

Referring to FIGS. 7-8, the rotatable disc wheel 140 can include four lenses 142, 144, 146 and 148. Instead of having a separate primary lens 35 covering the light source 22, all of the lens can be on the rotatable disc/wheel 140.

This embodiment 100 can have the same components and work similarly to the components in the previous embodiment with the exception of only using lenses on the rotatable disc 140. In this application, there can be four lenses 142, 144, 146 and 148. Lens 148 can convert the approximately 120 light spread from light source 122 to approximately 80 degrees when lens 148 is positioned in front of the light source 22. Rotating the disc 140 clockwise can allow for lens 142 to convert the light spread to approximately 60 degrees spread. Rotating the disc 140 clockwise can allow for lens 144 to convert the light spread to approximately 40 degrees. And rotating the disc 140 clockwise can allow for lens 142 to convert the light spread to approximately 20 degrees.

The term "approximately" can be +/−10% of the amount referenced. Additionally, preferred amounts and ranges can include the amounts and ranges referenced without the prefix of being approximately.

While the preferred embodiment shows a mechanically rotatable disc with a knob, the disc can be rotated by other techniques, such as but not limited to lever(s) with notches, sliders, magnets, and the like.

Although a preferred embodiment shows a rotatable disc in front of a fixed light source, the invention can work with more than one rotatable disc in front of the light source.

Although the rotatable disc has a plurality of lens, the invention can work with plural rotatable discs, each having one or more lens.

While the invention spotlight is generally described for use outdoors, the invention is not limited to outdoor use, and can be used indoors.

Although the invention describes ground based spotlight applications, the invention can be mounted to a support such as a post, against a wall, a ceiling, an overhang and the like, such as but not limited to track lighting, and the like. Additionally, the novel spotlight can be mounted on a stand that does not include a stake, and the like.

The spotlight can also be mounted on a ceiling fan, and the like.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

We claim:

1. A spotlight comprising:

a single housing;

a light source in the single housing for emitting a light beam with a light spread therefrom;

a disc rotatably supported within the single housing in front of the light source; and a plurality of lenses positioned about the disc for allowing light to pass therethrough, each of the plurality of lenses for narrowing the light spread to different narrower light spread angles, the rotatable disc being controlled from outside the housing, wherein rotating the disc to each of the plurality of lenses narrows the light spread to each of the different narrower light spread angles.

2. The spotlight of claim 1, further comprising:

a stake extending below the single housing for supporting the spotlight on a ground surface; and a pivot member attached between a top of the stake and a bottom of the housing for allowing the housing to pivot up and down relative to the stake.

3. The spotlight of claim 2, further comprising:

a rotatable component for allowing the single housing to rotate in a parallel plane to the stake.

4. The spotlight of claim 1, wherein the light source includes: an LED (light emitting diode).

5. The spotlight of claim 1, further comprising:

a primary lens fixed in front of the light source for converting the light spread emission from the light source.

6. The spotlight of claim 5, wherein the plurality of lenses on the single disc includes:

three lenses.

7. The spotlight of claim 6, further comprising:

a primary lens fixed in front of the light source for narrowing the light spread to approximately 80 degrees;

a first lens on the rotatable disc for changing the light spread to approximately 20 degrees;

a second lens on the rotatable disc for changing the light spread to approximately 40 degrees; and a third lens on the rotatable disc for changing the light spread to approximately 60 degrees.

8. The spotlight of claim 1, further comprising:

a heat sink behind the light source.

9. The spotlight of claim 1, further comprising:

a removable lens cap covering an open end of the housing.

10. The spotlight of claim 1, further comprising:

a rotatable knob to rotate the disc.

11. The spotlight of claim 10, further comprising:

a horizontal gear wheel attached to the rotatable knob; and a vertical gear wheel attached to the rotatable disc, wherein rotating the knob causes the horizontal gear wheel to rotate the vertical gear wheel which rotates the rotatable disc.

12. The spotlight of claim 11, wherein the one or more lens includes:

a first lens on the single disc for changing the light spread to approximately 20 degrees;

a second lens on the single disc for changing the light spread to approximately 40 degrees;

a third lens on the single disc for changing the light spread to approximately 60 degrees; and a fourth lens on the single disc for changing the light spread to approximately 60 degrees.

13. The spotlight of claim 1, further comprising:

at least one rotatable lens on the rotatable disc having one or more lens for adjusting light spread.

14. A mountable light, comprising:

a cylindrical housing;

a light source in the cylindrical housing for emitting a light beam with a light spread therefrom;

a disc rotatably supported within the cylindrical housing in front of the light source; and a plurality of lenses positioned about the disc for allowing light to pass therethrough, each of the plurality of lenses for narrowing the light spread to different narrower light spread angles, wherein rotating the disc to each of the plurality of lenses narrows the light spread to each of the different narrower light spread angles.

15. The mountable light of claim 14, further comprising:

a primary lens fixed in front of the light source for converting the light spread emission from the light source.

16. The mountable light of claim 15, wherein the plurality of lenses on the single disc includes:

three lenses.

17. The mountable light of claim 16, further comprising:

a primary lens fixed in front of the light source for narrowing the light spread to approximately 80 degrees;

a first lens on the rotatable disc for changing the light spread to approximately 20 degrees;

a second lens on the rotatable disc for changing the light spread to approximately 40 degrees; and a third lens on the rotatable disc for changing the light spread to approximately 60 degrees.

18. The mountable light of claim 14, further comprising:

at least one rotatable lens on the rotatable disc having one or more lens for adjusting light spread.

19. The mountable light of claim 18, wherein the one or more lens includes:

a first lens on the single disc for changing the light spread to approximately 20 degrees;

a second lens on the single disc for changing the light spread to approximately 40 degrees;

a third lens on the single disc for changing the light spread to approximately 60 degrees; and a fourth lens on the single disc for changing the light spread to approximately 60 degrees.

20. The mountable light of claim 14, further comprising:

a rotatable knob to rotate the disc;

a horizontal gear wheel attached to the rotatable knob; and a vertical gear wheel attached to the rotatable disc, wherein rotating the knob causes the horizontal gear wheel to rotate the vertical gear wheel which rotates the rotatable disc.

* * * * *